US005810181A

United States Patent [19]

Emalfarb et al.

[11] Patent Number: 5,810,181

[45] Date of Patent: Sep. 22, 1998

[54] RECONFIGURABLE DISPLAY STAND

[76] Inventors: Bradley S. Emalfarb, 29529 N. Hwy. 83, Mundelein, Ill. 60004; Seymour Emalfarb, 1585 Saunders Rd., Riverwoods, Ill. 60015

[21] Appl. No.: 698,448

[22] Filed: Aug. 30, 1996

[51] Int. Cl.[6] ..... A47F 3/14

[52] U.S. Cl. ..... 211/129.1; 108/94

[58] Field of Search ..... 211/181, 129, 211/165, 110; 108/59, 64, 91, 92, 93, 94, 103, 160, 176, 177, 178, 115, 131, 133, 95

[56] References Cited

U.S. PATENT DOCUMENTS

| | | | |
|---|---|---|---|
| 37,070 | 2/1862 | Crawford . | |
| 138,406 | 4/1873 | Johnson | 108/93 |
| 440,554 | 11/1890 | Fisher . | |
| 633,251 | 9/1899 | Stone . | |
| 1,957,353 | 5/1934 | Piersall . | |
| 2,591,362 | 4/1952 | Koch . | |
| 2,794,554 | 6/1957 | Donner . | |
| 3,013,758 | 12/1961 | Smith . | |
| 3,182,613 | 5/1965 | Hagan . | |
| 3,490,726 | 1/1970 | Mills . | |
| 3,511,461 | 5/1970 | Clark . | |
| 3,532,318 | 10/1970 | Lloyd . | |
| 3,538,862 | 11/1970 | Patriarca . | |
| 3,789,778 | 2/1974 | Brand . | |
| 4,248,352 | 2/1981 | White . | |
| 4,418,496 | 12/1983 | Koistinen . | |
| 4,739,582 | 4/1988 | Cullinane . | |

FOREIGN PATENT DOCUMENTS

| | | | |
|---|---|---|---|
| 3903351 | 8/1990 | Germany | 109/91 |
| 510286 | 1/1955 | Italy | 108/93 |

*Primary Examiner*—Peter M. Cuomo
*Assistant Examiner*—Gerald A. Anderson
*Attorney, Agent, or Firm*—Wood, Phillips, VanSanten, Clark & Mortimer

[57] ABSTRACT

A display stand having a first shelf for an article to be displayed, a first base for supporting the first shelf in a display position relative to a support for the display stand with the first shelf and first base having a combined vertical plan outline, a second shelf for an article to be displayed, and first structure cooperating between the second shelf and at least one of the first shelf and first base for guiding repositioning of the second shelf relative to the at least one of the first shelf and first base between a) a first position wherein a substantial portion of the second shelf resides outside of the combined vertical plan outline of the first shelf and first base, and b) a second position wherein the second shelf resides substantially entirely within the combined vertical plan outline of the first shelf and first base.

11 Claims, 2 Drawing Sheets

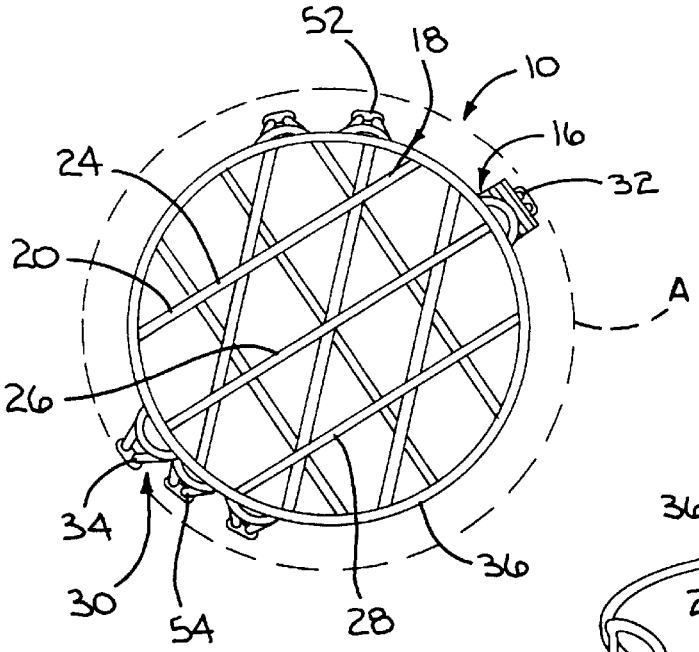
FIG. 4
FIG. 3
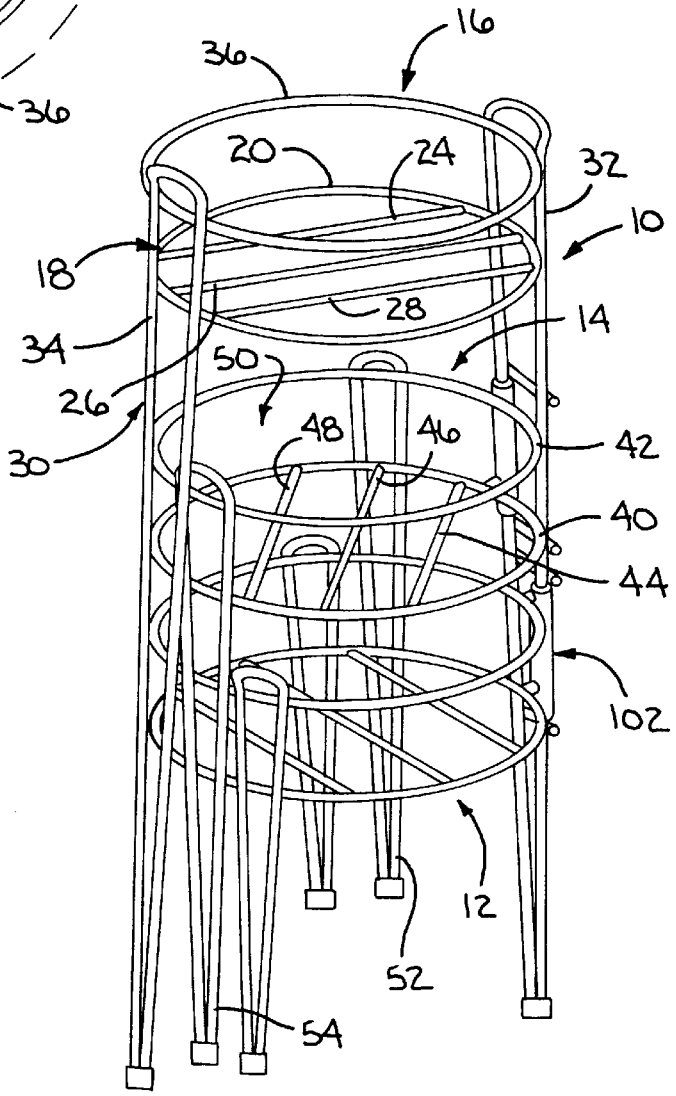
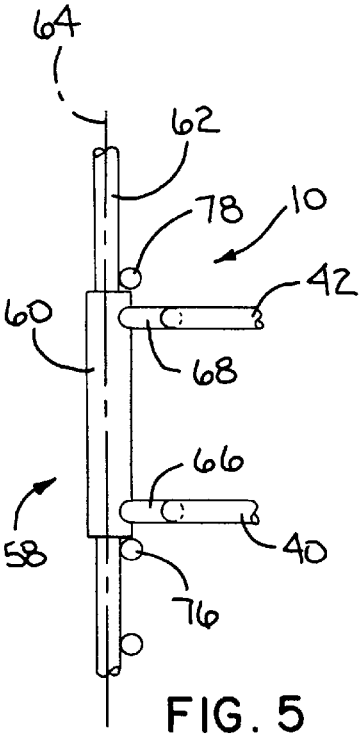
FIG. 5

RECONFIGURABLE DISPLAY STAND

BACKGROUND OF THE INVENTION

1. Field of the Invention

This invention relates to stands for displaying articles and, more particularly, to a stand that is selectively reconfigurable between a display state and a storage/transportation state.

2. Background Art

Stands are used for displaying a wide range of articles. One such stand has a tiered arrangement of shelves which allows articles to be displayed at different locations and different heights. This is a popular configuration for plant stands.

In one typical plant stand construction, the shelves and supporting bases are constructed from formed wire. One or more shelves are attached to a primary shelf and/or supporting base. If this type of stand is made in a fixed configuration, it may become quite bulky to handle. Typically, each stand is packaged in its own container. The container therefor, which may be a square cardboard box, must be dimensioned to accommodate the vertical plan outline of the stand. As a result, the stand may occupy a small percentage of the volume of the inside container space. Since this type of stand is a relatively low cost item, sales may be made in high volume. Accordingly, large amounts of storage space may be required by the manufacturer and at the point of purchase to accommodate these products. Physical handling of these potentially large containers is also inherently difficult, even though the containers with the stands are relatively light in weight.

It is known to construct reconfigurable stands wherein the shelves can be repositioned relative to a primary shelf or supporting base. Exemplary stands are shown in each of U.S. Pat. Nos. 37,070, to Crawford; 440,554, to Fisher; 633,241, to Stone; 2,591,362, to Koch; 2,794,554, to Donner; 3,182,613, to Hagan; 3,538,862, to Patriarca; and 3,789,778, to Brand.

SUMMARY OF THE INVENTION

In one form of the invention, a display stand is provided having a first shelf for an article to be displayed, a first base for supporting the first shelf in a display position relative to a support for the display stand with the first shelf and first base having a combined vertical plan outline, a second shelf for an article to be displayed, and first structure cooperating between the second shelf and at least one of the first shelf and first base for guiding repositioning of the second shelf relative to the at least one of the first shelf and first base between a) a first position wherein a substantial portion of the second shelf resides outside of the combined vertical plan outline of the first shelf and first base, and b) a second position wherein the second shelf resides substantially entirely within the combined vertical plan outline of the first shelf and first base.

In one form, the first cooperating structure guides pivoting movement of the second shelf about a first axis between the first and second positions.

In one form, the first base has a first upstanding leg, with the first cooperating structure cooperating between the second shelf and the first upstanding leg.

In one form, a third shelf is provided for an article to be displayed, with there being second structure cooperating between the third shelf and at least one of the first shelf, the first base, and the second shelf for guiding repositioning of the third shelf between a) a first position wherein a substantial portion of the third shelf resides outside of the combined vertical plan outline of the first shelf and first base and b) a second position wherein the third shelf resides substantially entirely within the combined vertical plan outline of the first shelf and first base.

In one form, the first base has a first upstanding leg and there is a second base having a second upstanding leg for supporting the second shelf in at least one of the first and second positions relative to a support for the display stand and the second upstanding leg resides outside of the combined vertical plan outline of the first shelf and first base with the second shelf in the first position.

The second base may have a third upstanding leg for supporting the second shelf in at least one of the first and second positions relative to a support for the display stand with the third upstanding leg residing outside of the combined vertical plan outline of the first shelf and first base with the second shelf in the first position and substantially within the combined vertical plan outline of the first shelf and first base with the second shelf in the second position.

In one form, the first, second, and third shelves each have upwardly facing support surfaces for articles to be displayed and the upwardly facing support surfaces are vertically spaced, each from the other.

The upwardly facing support surfaces may all have substantially the same vertical plan outline.

In one form, the first base and first and second shelves are made substantially entirely from formed wire. The wire may have a metal core with a coating thereon.

In another form of the invention, a display stand is provided having a first shelf for an article to be displayed, a first base for supporting the first shelf in a display position relative to a support for the display stand with the first shelf and first base having a combined vertical plan outline, a second shelf for an article to be displayed and being repositionable between a) a first position wherein a substantial portion of the second shelf resides outside of the combined vertical plan outline of the first shelf and first base and b) a second position wherein the second shelf resides substantially entirely within the combined vertical plan outline of the first shelf and first base, and first structure cooperating between a part of the second shelf and at least one of the first shelf and first base for supporting the part of the second shelf with the first shelf in the first position.

A third shelf may be provided that is repositionable between a) a first position wherein a substantial portion of the third shelf resides outside of the combined vertical plan outline of the first shelf and first base and b) a second position wherein the third shelf resides substantially entirely within the combined vertical plan outline of the first shelf and first base. Second structure cooperates between a part of the third shelf and at least one of the first shelf, first base, and second shelf for supporting the part of the third shelf with the third shelf in the first position.

The first base may include a first upstanding leg, with the first cooperating structure cooperating between the part of the second shelf and the first upstanding leg.

A second base can be provided for supporting the second shelf, with the second base having a second upstanding leg. The second leg may reside outside of the combined vertical plan outline of the first shelf and first base with the second shelf in its first position.

The second base may include a third upstanding leg for supporting the second shelf.

In another form, the third shelf is repositionable between a) a first position wherein a substantial portion of the third shelf resides outside of the combined vertical plan outline of the first shelf and first base and b) a second position wherein the third shelf resides substantially entirely within the combined vertical plan outline of the first shelf and first base. Second structure cooperates between a part of the third shelf and at least one of the first shelf, first base and second shelf for supporting the part of the third shelf with the third shelf in its first position. A third base can be provided for supporting the third shelf, with the third base having first and second upstanding legs.

At least the first base and first shelf may be made substantially entirely from formed wire.

BRIEF DESCRIPTION OF THE DRAWINGS

FIG. 3 is a perspective view of the display stand in FIGS. 1 and 2 with the shelves relatively positioned into a storage/transportation state;

FIG. 4 is a plan view of the display stand in FIG. 3; and

FIG. 5 is an enlarged, cross-sectional view of the connection for one of the shelves on the display stand that allows repositioning thereof and taken along line 5—5 of FIG. 2.

DETAILED DESCRIPTION OF THE DRAWINGS

Figure 1:
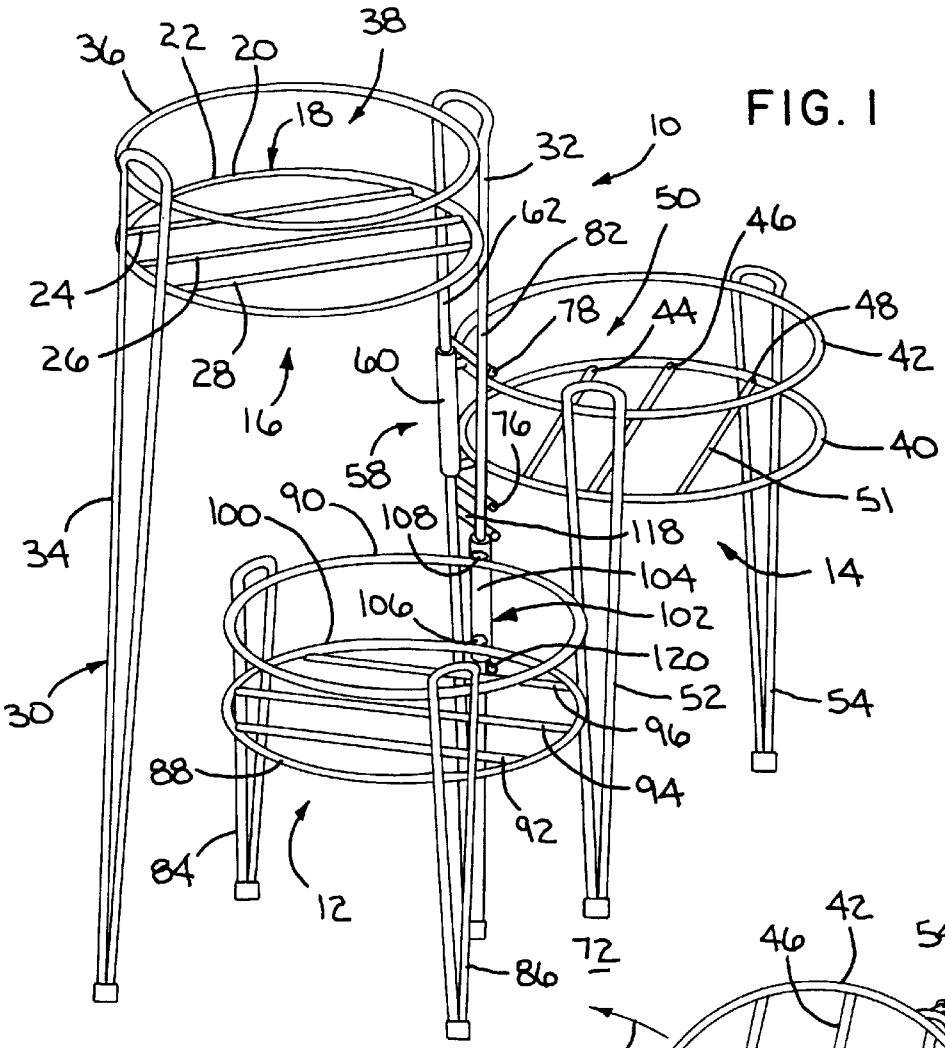
FIG. 1 is a perspective view of a display stand, according to the present invention, and having three shelves relatively positioned so that the display stand is in a display state.
Figure 2:
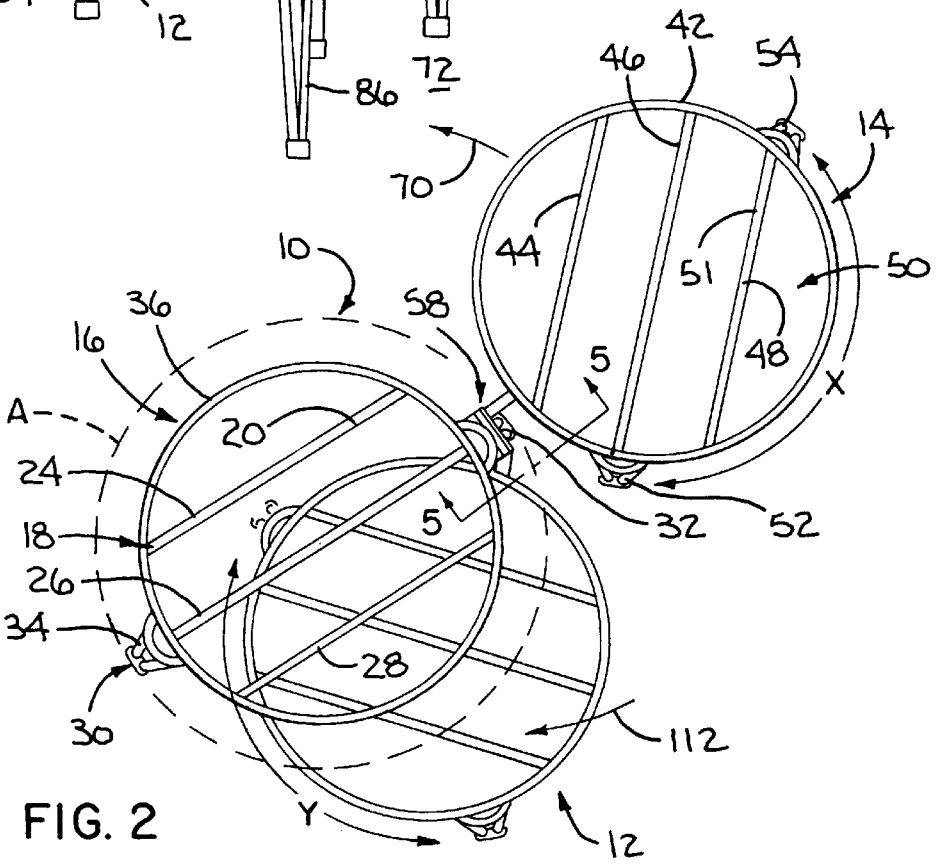
FIG. 2 is a plan view of the display stand of FIG. 1.

A preferred form of display stand, according to the present invention, is shown at 10. The display stand 10 has three different shelf assemblies 12, 14, 16 which are repositionable relative to each other to selectively place the display stand 10 in a display state, as shown in FIGS. 1 and 2, and a storage/transportation state, shown in FIGS. 3 and 4.

The shelf assembly 16 has a shelf 18 with an upwardly facing surface 20, defined cooperatively by a ring 22 and three straight elements 24, 26, 28 bridging the ring 22 at different locations, to cooperatively support an article (not shown) in a display position.

The shelf assembly 16 has a base 30, for supporting the shelf 18 and defined by inverted, U-shaped, upstanding legs 32, 34 connected at diametrically opposite locations to the ring 22. The shelf assembly 16 has an upper ring 36, having substantially the same configuration as the ring 22, that is joined to the legs 32, 34, whereby the legs 32, 34 are rigidified and there is defined a receptacle 38 for the articles to be displayed having a depth equal to the vertical spacing between the rings 22, 36.

The shelf assembly 14 is similar to the shelf assembly 16 in that it has vertically spaced rings 40, 42, with the former having straight elements 44, 46, 48 bridging the diameter of the ring 40, with the rings 40, 42 and straight elements 44, 46, 48 cooperatively defining a receptacle 50 for articles to be displayed on the shelf assembly 14. The ring 40 and straight elements 44, 46, 48 cooperatively define a shelf 51 to support articles to be displayed.

The shelf assembly 14 has inverted, U-shaped legs 52, 54, joined to the rings 40, 42 so that the legs 52, 54 are spaced around the rings 40, 42 by an arc X that is on the order of 165°.

Means is provided at 58 cooperating between the shelf assembly 16 and the shelf assembly 14 for guiding repositioning of the shelf 51 and shelf assembly 14 between a first position, shown in FIGS. 1 and 2 and corresponding to the display state for the display stand 10, and a second position, shown in FIGS. 3 and 4, corresponding to the storage/transportation state for the display stand 10. In the first position, a substantial portion of the shelf 51 and shelf assembly 14 reside outside of a combined vertical plan outline of the shelf 18 and base 30. The combined vertical plan outline A is the outline defined by the smallest diameter circle that will circumscribe the first shelf 18 and base 30 as viewed in plan as in FIGS. 2 and 4. Preferably, the entire, or substantially the entire, shelf assembly 14 is positionable outside the combined vertical plan outline A in the first position therefor, as seen in FIGS. 1 and 2. With the shelf 51 and shelf assembly 14 in the second position of FIG. 4, corresponding to the display/storage state for the display stand 10, the shelf 51 and shelf assembly 14 reside entirely, or substantially entirely, within the vertical plan outline A of the shelf 18 and base 30.

More particularly, the means 58 is made up of a sleeve 60 which surrounds one of two vertically extending elements 62 defining the leg 32. The sleeve 60 is free to pivot relative to the element 62 around an axis 64 extending lengthwise of the element 62. Vertically spaced connecting bars 66, 68 connect one each between the sleeve 60 and the rings 40, 42. The length of the bars 66, 68 is selected so that the shelf assembly 14 can be pivoted from the first position in FIG. 2 in the direction of the arrow 70 around the axis 64 into the second position wherein, in plan view, the center of the receptacle 50 is substantially coincident with the center of the receptacle 38, i.e. the rings 40, 42 and 20, 36 are substantially concentric.

With this arrangement, and the shelf assembly 14 in the first position of FIGS. 1 and 2, the legs 52, 54 on the shelf assembly 14 and the leg 32 on the shelf assembly 16 cooperatively support the shelf assembly 14 stably on a subjacent surface 72. To further stabilize this structure, reinforcing bars 76, 78 span the vertically extending element 62 and the other vertically extending element 82 on the leg 32 to thereby reinforce the leg 32 and confine shifting of the sleeve 60 along the length of the element 62.

The shelf assembly 12 is similar to the shelf assembly 14 and includes two upstanding legs 84, 86 that support a pair of rings 88, 90, which are spanned by straight elements 92, 94, 96. The ring 88 and straight elements 92, 94, 96 cooperatively define a shelf 98 with upwardly facing support surface 100. The legs 84, 86 are spaced through an arc Y on the order of 165°.

A means at 102 cooperates between the shelf assembly 12 and the vertical element 82 on the leg 32 to allow the shelf assembly 12 to reposition relative to the shelf assembly 16 between a first position, shown in FIGS. 1 and 2, wherein a substantial portion of the shelf assembly 12 resides outside of the vertical plan outline A, and a second position, as shown in FIGS. 3 and 4, wherein the shelf assembly 12 resides substantially entirely within the vertical plan outline A. The means 102 is substantially the same in construction as the means 58. That is, there is a sleeve 104 which surrounds the vertically extending element 82 on the leg 32 with connecting bars 106, 108 fixedly attached to the sleeve 104 and one each to the rings 88, 90. Through this arrangement, the shelf assembly 12 is allowed to pivot from the first position in FIGS. 1 and 2 in the direction of the arrow 112 into the second position of FIGS. 3 and 4. Reinforcing bars 118, 120 confine vertical shifting of the sleeve 104 and also rigidify the elements 62, 82 on the leg 32. With this arrangement, the shelf assembly 12 can be stably supported in the first position on the surface 72 cooperatively by the legs 84, 86 on the shelf assembly 12 and the leg 32 on the shelf assembly 16.

With the above described structure, the user has the flexibility of reconfiguring the display stand 10 by selectively relatively moving the shelf assemblies 12, 14, 16. As seen in FIG. 2, the user has the option of leaving the shelf assembly 14 in its second position and pivoting the shelf assembly 12 to its first position whereby it is substantially fully outside of the vertical plan outline A. Alternatively, the shelf assembly 12 can be left in its second position and the shelf assembly 14 pivoted into its first position through a range of different locations. Between these two positions, the shelf assemblies 12, 14 can be pivoted to the point that they interfere with one another as would occur, for example, if the shelf assembly 12 is pivoted further oppositely to the direction of the arrow 112 and encounters the shelf assembly 14.

When it is desired to store and/or transport the display stand, the user can simply pivot the shelf assemblies 12, 14 to their respective second positions. By reason of having the legs 84, 86; 52, 54; and 32, 34 of progressively increasing height, the shelf assembly 14 is allowed to nest beneath the ring 22 on the shelf assembly 16, with the shelf assembly 12 in turn positionable to nest beneath the ring 40 on the shelf assembly 14.

In a preferred form, substantially the entire display stand 10 is made from a formed wire material. The wire material is commonly used in the prior art and typically has a metal core with a protective rubber or plastic coating thereon.

The foregoing disclosure of specific embodiments is intended to be illustrative of the broad concepts comprehended by the invention.

We claim:

1. A display stand comprising:

a first shelf for an article to be displayed;

a first base for supporting the first shelf in a display position relative to a support for the display stand, said first shelf and first base having a combined vertical plan outline;

a second shelf for an article to be displayed;

a base for supporting the second shelf in a display position relative to a support for the display stand;

first means cooperating between the second shelf and at least one of the first shelf and first base for guiding repositioning of the second shelf relative to the at least one of the first shelf and first base between a) a first position wherein a substantial portion of the second shelf resides outside of the combined vertical plan outline of the first shelf and first base and b) a second position wherein the second shelf resides substantially entirely within the combined vertical plan outline of the first shelf and first base;

a third shelf for an article to be displayed; and second means cooperating between the third shelf and at least one of the first shelf, the first base, the second shelf, and the base for supporting the second shelf for guiding repositioning of the third shelf between a) a first position wherein a substantial portion of the third shelf resides outside of the combined vertical plan outline of the first shelf and first base and b) a second position wherein the third shelf resides substantially entirely within the combined vertical plan outline of the first shelf and first base, wherein the first, second, and third shelves each have upwardly facing support surfaces for articles to be displayed and the upwardly facing support surfaces are vertically spaced, each from the other, wherein the second and third shelves are repositionable relative to each other and the first shelf, wherein the upwardly facing support surfaces on the first, second and third shelves are in overlying relationship, each with the other, as viewed in vertical plan with the second and third shelves in their second positions.

2. The display stand according to claim 1 wherein the first cooperating means comprises means for guiding pivoting movement of the second shelf about a first axis between the first and second positions.

3. The display stand according to claim 2 wherein the first base comprises a first upstanding leg and the first cooperating means comprises means cooperating between the second shelf and the first upstanding leg.

4. The display stand according to claim 1 wherein the upwardly facing support surfaces on the first, second and third shelves are each substantially circular as viewed in vertical plan.

5. The display stand according to claim 1 wherein the first base comprises a first upstanding leg and the base for supporting the second shelf comprises a second upstanding leg for supporting the second shelf in at least one of the first and second positions relative to a support for the display stand and the second upstanding leg resides outside of the combined vertical plan outline of the first shelf and first base with the second shelf in the first position.

6. The display stand according to claim 1 wherein the first base and first and second shelves are made substantially entirely from formed wire.

7. The display stand according to claim 6, wherein the wire comprises a metal core with a coating thereon.

8. A display stand comprising:

a first shelf for an article to be displayed;

a first base for supporting the first shelf in a display position relative to a support for the display stand, said first shelf and first base having a combined vertical plan outline;

a second shelf for an article to be displayed; and first means cooperating between the second shelf and at least one of the first shelf and first base for guiding repositioning of the second shelf relative to the at least one of the first shelf and first base between a) a first position wherein a substantial portion of the second shelf resides outside of the combined vertical plan outline of the first shelf and first base and b) a second position wherein the second shelf resides substantially entirely within the combined vertical plan outline of the first shelf and first base, a third shelf for an article to be displayed; and second means cooperating between the third shelf and at least one of the first shelf, the first base, and the second shelf for guiding repositioning of the third shelf between a) a first position wherein a substantial portion of the third shelf resides outside of the combined vertical plan outline of the first shelf and first base and b) a second position wherein the third shelf resides substantially entirely within the combined vertical plan outline of the first shelf and first base, wherein the first, second, and third shelves each have upwardly facing support surfaces for articles to be displayed and the upwardly facing support surfaces are vertically spaced, each from the other, wherein the upwardly facing support surfaces all have substantially the same vertical plan outline.

9. A display stand comprising:

a first shelf for an article to be displayed;

a first base for supporting the first shelf in a display position relative to a support for the display stand, said first shelf and first base having a combined vertical plan outline;

a second shelf for an article to be displayed; and first means cooperating between the second shelf and at least one of the first shelf and first base for guiding repositioning of the second shelf relative to the at least one of the first shelf and first base between a) a first position wherein a substantial portion of the second shelf resides outside of the combined vertical plan outline of the first shelf and first base and b) a second position wherein the second shelf resides substantially entirely within the combined vertical plan outline of the first shelf and first base, wherein the first base comprises a first upstanding leg and there is a second base comprising a second upstanding leg for supporting the second shelf in at least one of the first and second positions relative to a support for the display stand and the second upstanding leg resides outside of the combined vertical plan outline of the first shelf and first base with the second shelf in the first position, wherein the second base comprises a third upstanding leg for supporting the second shelf in at least one of the first and second positions relative to a support for the display stand and the third upstanding leg resides outside of the combined vertical plan outline of the first shelf and first base with the second shelf in the first position and substantially within the combined vertical plan outline of the first shelf and first base with the second shelf in the second position.

10. A display stand comprising:

a first shelf for an article to be displayed;

a first base for supporting the first shelf in a display position relative to a support for the display stand, said first shelf and first base having a combined vertical plan outline;

a second shelf for an article to be displayed, said second shelf being repositionable between a) a first position wherein a substantial portion of the second shelf resides outside of the combined vertical plane outline of the first shelf and first base and b) a second position wherein the second shelf resides substantially entirely within the combined vertical plan outline of the first shelf and first base; and first means cooperating between a part of the second shelf and at least one of the first shelf and first base for supporting the part of the second shelf with the first shelf in the first position, wherein the first base comprises a first upstanding leg and the first cooperating means comprises means cooperating between the part of the second shelf and the first upstanding leg;

a second base for supporting the second shelf, said second base comprising a second upstanding leg; and wherein the second base comprises a third upstanding leg for supporting the second shelf.

11. The display stand according to claim 10 including a third shelf that is repositionable between a) a first position wherein a substantial portion of the third shelf resides outside of the combined vertical plane outline of the first shelf and first base and b) a second position wherein the third shelf resides substantially entirely within the combined vertical plan outline of the first shelf and first base and second means cooperating between a part of the third shelf and at least one of the first shelf, first base, and second shelf for supporting the part of the third shelf with the third shelf in its first position and there is a third base for supporting the third shelf, said third base comprising first and second upstanding legs.

* * * * *